US010352319B2

(12) United States Patent
Hernandez Martinez et al.

(10) Patent No.: US 10,352,319 B2
(45) Date of Patent: Jul. 16, 2019

(54) CALIBRATION OF A PUMP

(71) Applicant: HEWLETT-PACKARD DEVELOPMENT COMPANY, L.P., Houston, TX (US)

(72) Inventors: Bhishma Hernandez Martinez, Sant Cugat del Valles (ES); Michel Georges Encrenaz, Sant Cugat del Valles (ES); Fernando Bayona Alcolea, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/540,884

(22) PCT Filed: Jan. 29, 2015

(86) PCT No.: PCT/EP2015/051831

§ 371 (c)(1),
(2) Date: Jun. 29, 2017

(87) PCT Pub. No.: WO2016/119859

PCT Pub. Date: Aug. 4, 2016

(65) Prior Publication Data

US 2018/0010599 A1 Jan. 11, 2018

(51) Int. Cl.

| | |
|---|---|
| ***B41J 2/175*** | (2006.01) |
| ***F04B 1/00*** | (2006.01) |
| ***F04B 51/00*** | (2006.01) |
| ***F04B 13/00*** | (2006.01) |
| ***F04B 49/06*** | (2006.01) |

(Continued)

(52) U.S. Cl.

CPC ..... *F04B 51/00* (2013.01); *B41F 33/00* (2013.01); *B41J 2/175* (2013.01); *B41J 2/17596* (2013.01); *F04B 13/00* (2013.01); *F04B 49/065* (2013.01); *F04B 49/20* (2013.01); *F04B 43/02* (2013.01);

(Continued)

(58) Field of Classification Search

CPC ..... F04B 51/00; B41F 33/00

See application file for complete search history.

(56) References Cited

U.S. PATENT DOCUMENTS

| | | | |
|---|---|---|---|
| 5,695,092 | A | 12/1997 | Schrandt |
| 6,783,215 | B2 | 8/2004 | Yoshida et al. |

(Continued)

FOREIGN PATENT DOCUMENTS

| | | |
|---|---|---|
| DE | 10112848 | 9/2001 |
| EP | 2088001 | 8/2009 |

(Continued)

OTHER PUBLICATIONS

Viktor Kovalevski. Viktor Kovalevski Portals. Problem with air-pump in 2012. Printer Epson 7900. Dec. 16, 2014.

*Primary Examiner* — Jason S Uhlenhake

(74) *Attorney, Agent, or Firm* — HP Inc. Patent Department

(57) ABSTRACT

A pump for the transfer a predetermined total volume of fluid from a pump inlet to a pump outlet in a unit of time is calibrated by deriving a count of the number of times a volume of the fluid is transferred from a pump inlet to a pump outlet in a unit of time; and adjusting the number of times the volume is transferred in a unit of time until the derived count is substantially equal to a predetermined threshold value.

13 Claims, 8 Drawing Sheets

(51) Int. Cl.

| | |
|---|---|
| ***B41F 33/00*** | (2006.01) |
| ***F04B 49/20*** | (2006.01) |
| *F04B 43/02* | (2006.01) |

(52) U.S. Cl.
CPC ..... *F04B 2205/04* (2013.01); *F04B 2205/05* (2013.01)

(56) References Cited

U.S. PATENT DOCUMENTS

| | | | |
|---|---|---|---|
| 8,177,313 | B2 | 5/2012 | Suzuki et al. |
| 8,424,986 | B2 | 4/2013 | Lewis et al. |
| 2010/0188454 | A1 | 7/2010 | Murakami et al. |
| 2012/0193290 | A1 | 8/2012 | Breuel et al. |
| 2012/0327145 | A1 | 12/2012 | Pouzet |
| 2013/0293640 | A1 | 11/2013 | McCallum et al. |

FOREIGN PATENT DOCUMENTS

| | | |
|---|---|---|
| EP | 2572886 | 3/2013 |
| WO | WO-9318301 | 9/1993 |
| WO | WO-2002096653 | 12/2002 |
| WO | WO-2006075314 | 7/2006 |
| WO | WO-2006113408 | 10/2006 |
| WO | WO-2015007596 | 1/2015 |
| WO | WO2015007596 A1 * | 1/2015 |

* cited by examiner

CALIBRATION OF A PUMP

BACKGROUND

Complex mechatronics subsystems are used in controlling the transfer of a volume of a fluid by a pump or each of a plurality of pumps. For example, in the transfer of a predetermined volume of a fluid, such as a printing fluid in printing apparatus in which the amount of fluid being transferred is accurately controlled.

BRIEF DESCRIPTION OF DRAWINGS

For a more complete understanding, reference is now made to the following description taken in conjunction with the accompanying drawings in which.

DETAILED DESCRIPTION

Mechatronic systems are one of the most complex parts to manage and it is increasingly difficult to accurately detect and control the behavior of such systems. This is partly caused by the increased complexity of such systems and the number of mechatronics subsystems that need to be detected and managed properly. Complex and numerous mechatronics subsystems may be used in controlling pumps in printing apparatus for the accurate transfer of a fluid, for example printing fluid, such as an ink or treatment fluids.

Further, any faults or failure of any parts of these subsystems may be difficult to detect. These faults or failures may occur due to unexpected situations that cannot be controlled, for example, shocks that printing apparatus could receive during its life, subassembly child mortality, disconnections, electronics damage, wastage, for example.

Furthermore, in high throughput printing processes, high volumes of printing fluid are used. The supply of printing fluid is provided by inserting a supply tank of the printing fluid, for example, an ink cartridge into the panting apparatus. However such supply tanks hold a predetermined volume and once the supply tank (or cartridge) is empty, it has to be replaced. As the throughput of the printing process increases, the frequency of the supply tank replacement increases, slowing down the printing process. The frequency of replacement can be reduced by providing a larger supply volume of the printing fluid. However, increasing the size of the supply tanks (cartridges) would cause adaptation of the printing apparatus to enable larger tanks to be inserted into the apparatus. However, there are still imposed restrictions on the size of the supply tanks that can be inserted, as printing apparatus have a predetermined space for such supply tanks. Printing apparatus may comprise a plurality of supply tanks for supplying different inks or different treatment fluids which further restricts the space available for the supply tanks and hence restricts the size of the supply tanks.

Figure 1:
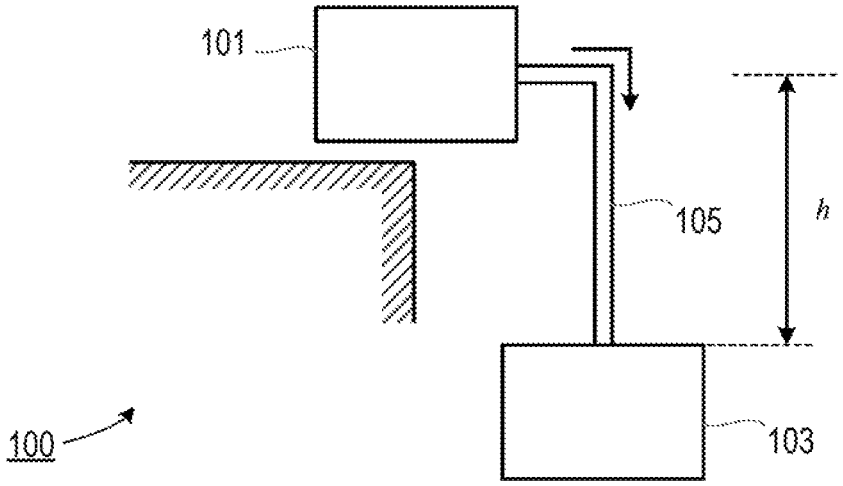
FIG. 1 is a simplified schematic of a prior example of fluid supply for printing apparatus.

As shown in FIG. 1, an initial supply tank 101 feeds an intermediate supply tank 103 via tubing 105. The intermediate supply tank 103 may comprise a removably, insertable supply tank (cartridge) which, in use, is inserted into a corresponding interface of the printing apparatus. The initial supply tank 101 is capable of holding a greater volume of fluid than the intermediate supply tank 103. For example, the initial supply tank 101 may hold a fluid volume of 3000 cc of panting fluid and the intermediate tank 103 may hold a volume of 775 cc of printing fluid. The initial supply tank 101 is located at a height h above the intermediate supply tank 103 such that the printing fluid flows due to gravity and the pressure generated due to the height difference, h, between the initial supply tank 101 and the intermediate supply tank 103. As a result fluid is fed to the intermediate supply tank 103 inserted into the printing apparatus from a larger supply tank 101 outside of the apparatus, thus creating an increased volume of fluid available to the printing apparatus with less frequent replacement.

Figure 2:
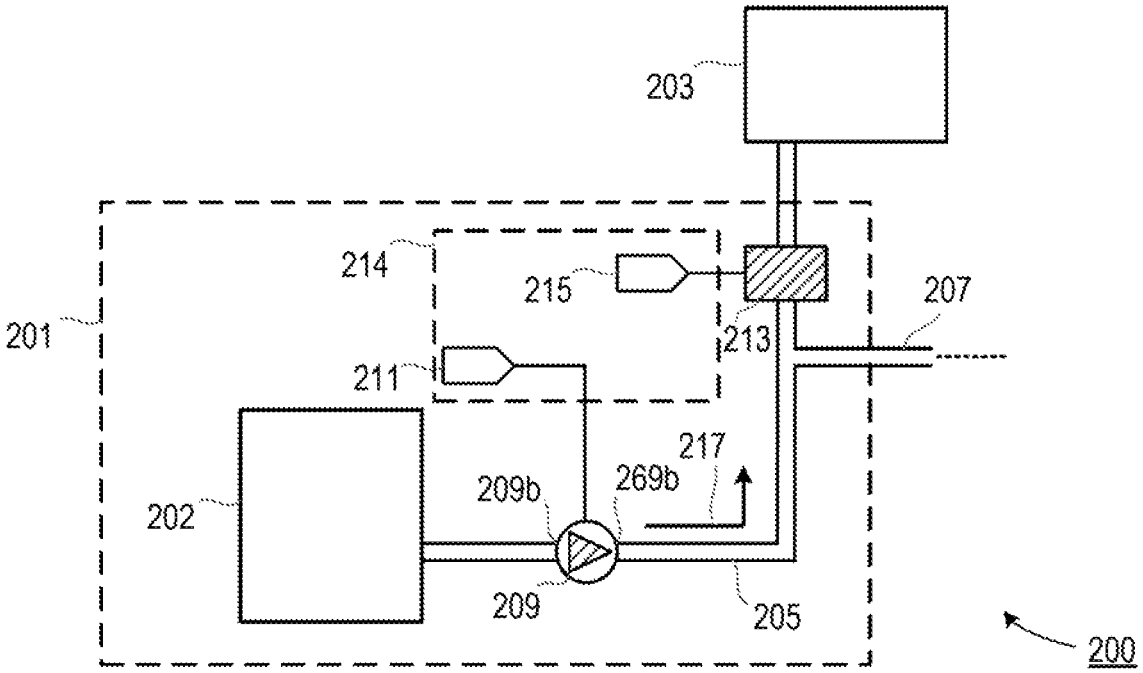
FIG. 2 is simplified schematic of an example of an accessory for fluid transfer for printing apparatus.

In the example shown in FIG. 2, an accessory 201 is inserted into the accessory port of printing apparatus and connected to the subsystem for controlling the flow of printing fluids. For example, the accessory 201 may be connected to an existing accessory port of a printing apparatus via a cable. The printing apparatus comprises an interface (not shown in the Figures) to receive at least one removably insertable fluid supply tank 203, for example, an ink cartridge. For simplicity a single removably insertable fluid supply tank 203 is illustrated. It can be appreciated that the printing apparatus may include a plurality of such removably, insertable fluid supply tanks to accommodate different inks and different treatment fluids. The accessory 201 comprises at least one initial supply tank 202 (again for simplicity a single initial supply tank 202 is illustrated in FIG. 2). The initial supply tank 202 contains a supply volume of a printing fluid, for example a volume of 3000 cc of printing fluid. In one example, the accessory 201 comprises an initial supply tank 202 for each respective removably, insertable fluid supply tank 203.

The accessory 201 further comprises at least one pump 209 (one pump is illustrated in FIG. 2) to transfer an amount of the printing fluid from each initial supply tank 202 to each removably insertable fluid supply tank 203 when the removably insertable fluid supply tank 203 is inserted in the interface of the printing apparatus. The printing fluid is transferred from the initial supply tank 202 to the intermediate supply tank 203 via tubing 205, interconnecting the initial supply tank 202 and the intermediate supply tank 203, by the pumping action of the pump 209 in the direction of the arrow 217. In one example, accessory 201 comprises a pump 209 for each of the removably, insertable fluid supply tanks 203 and its corresponding initial supply tank 202. A volume of the printing fluid is transferred along the tubing 205 by the pump 209, in the direction from the pump inlet 209*a* to the pump outlet 209*b* (direction of arrow 217).

The accessory 201 further comprises at least one pressure sensor 213 single sensor is shown in FIG. 2). In one example, the accessory 201 comprises a pressure sensor for each pump 209 of each removably, insertable supply tank. The pressure sensor 213 is located downstream of the pump 209.

During calibration of the accessory 201, the pressure sensor 213 measures the pressure of the printing fluid within the tubing 205 at the pump outlet 209*b* before the fluid enters the removably insertable fluid supply tank 203. As a result, the pressure sensor 213 outputs a measure of the pressure of a volume of transferred printing fluid at the outlet 209*b* of the pump 209. In another example, pressure measurements are taken by sensing pressure pulses at the pump outlet 209*b* as well as, or, at the inlet of the intermediate fluid supply tank 203.

The accessory 201 further comprises a calibrator 214 to derive a count of the number of times the volume of the fluid is transferred in a unit of time. This count is derived from the pressure sensor output provided on the input terminal 215 of the calibrator 214. The calibrator 214 is further to adjust the number of times the volume is transferred, via an output terminal 211, until the derived count is substantially equal to a predetermined threshold value.

Figure 3A:
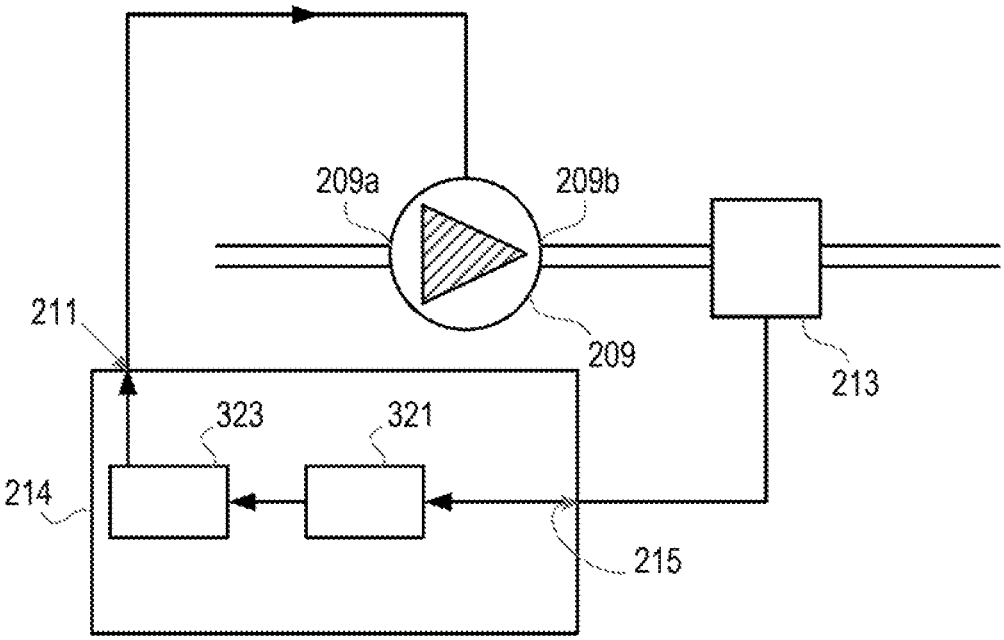
FIG. 3*a* is simplified schematic of an example of a calibration system for a pump.

The calibrator 214 of the pump 209 is shown in more detail in FIG. 3*a*. The pressure sensor 213, located downstream of the pump 209 at the pump outlet 209*a*, outputs pressure readings to an input terminal 215 of the calibrator 214. The input terminal 215 of the calibrator 214 is connected to a counter 321. The counter 321 derives a count of the number of times the volume of the fluid is transferred from the pump inlet 209*a* to the pump outlet 209*b* in a unit of time. The calibrator 214 also comprises an adjustor 323 connected to the counter 321 to adjust the number of times the volume is transferred until the derived count is substantially equal to a predetermined threshold value and outputs control signals on an output terminal 211 of the calibrator 214. The output terminal 211 of the calibrator 214 is connected to the pump 209 to control the duty cycle of operation of the pump and/or the power supply to the pump 209 to adjust the operation of the pump 209 such that the number of times the volume is transferred is adjusted until the derived count is substantially equal to a predetermined threshold value.

In one example, the counter 321 of the calibrator 214 that derives the count from the pressure sensor output and the adjustor 323 that regulates the operation of the pump 209 may be provided within the same microcontroller. In another example, the counter 321 and the adjustor 323 may be provided within separate, interconnected microcontrollers.

In one example, the counter 321 comprises an Analog Digital Converter (ADC) which obtains ADC values of the pressure sensor output. In another example, the counter 321 comprises a compare/counter input pin that counts the occurrence of events in the pressure sensor output, for example, how many times the signal output of the pressure sensor changes in a unit of time.

Figure 3B:
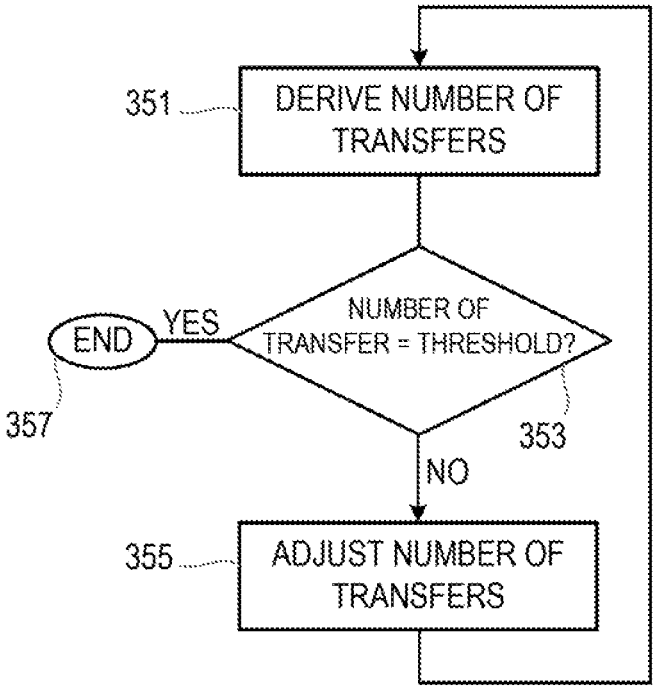
FIG. 3*b* is a flowchart of an example of a method of calibrating a pump.

In the example shown in FIG. 3*b*, the calibrator 214 calibrates the pump 209 so that the amount of fluid being transferred from a pump inlet 209*a* to a pump outlet 209*b* is accurate. This is achieved by deriving 351 a count of the number of times a volume of the fluid is transferred from the pump inlet 209*a* to the pump outlet 209*b* in a unit of time; and adjusting 355 the number of times the volume is transferred until the derived count is substantially equal to a predetermined threshold value, 353, 357.

In one example, the calibrator is further to determine the total amount of printing fluid transferred from each at least one initial supply tank to each corresponding at least one removably insertable fluid supply tank when inserted in the interface of the printer; and to provide an output to indicate that the at least one removably insertable fluid supply tank is full. In another example, the calibrator is further to determine when each at least one removably insertable fluid supply tank, when inserted in the interface of the printer, is empty when a moving standard deviation of the measure of the pressure output by each corresponding at least one pressure sensor reaches a predetermined threshold value.

Figure 4:
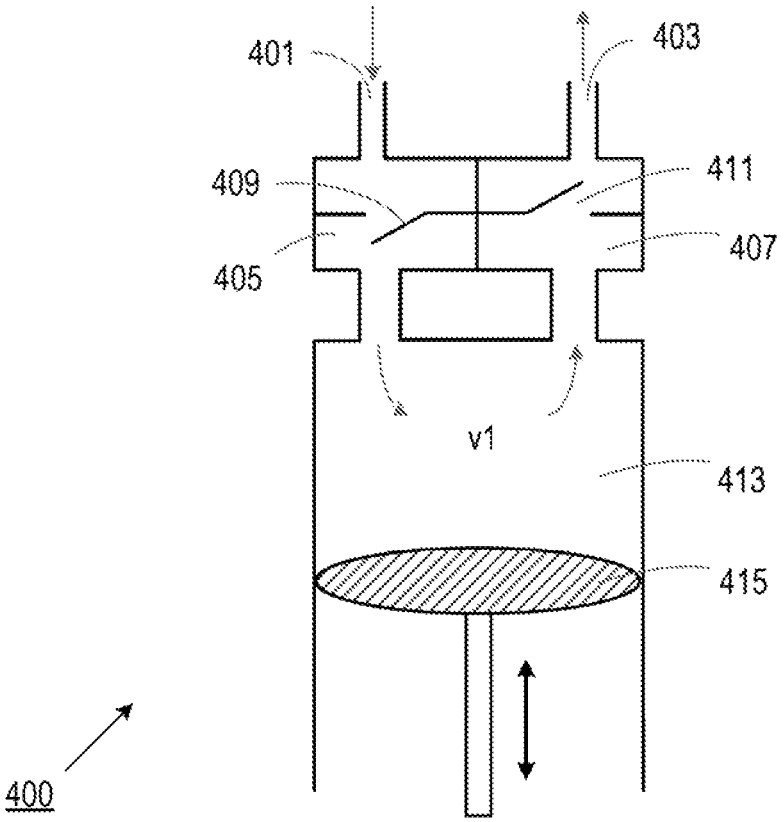
FIG. 4 is an example of a pump for the transfer of fluid.

In one example, the pump 209 is an eccentric diaphragm pump 400 as shown in FIG. 4. The pump 400 comprises an inlet 401 connected to an input chamber 405. The input chamber 405 contains a non-return check valve 409. The input chamber 405 is connected to a main chamber 413. The pump 400 further comprises an outlet 403 connected to an output chamber 407. The output chamber 407 contains a non-return check valve 411. The output chamber 407 is also connected to the main chamber 413.

The main chamber 413 comprises a piston 415 which moves linearly within the main chamber 413 to decrease and increase the internal volume of the main chamber 413 such that as the piston 415 retracts it increases the volume of the main chamber 413 causing a volume of fluid to be transferred through the inlet 401 into the input chamber 405 and into the increased volume created in the main chamber 413. The non-return check valve 409 prevents any of the transferred volume of fluid to flow back out of the inlet 401.

The piston 415 then extends into the created volume of the main chamber 413 decreasing the volume of the main chamber 413 and forcing the volume of fluid out of the main chamber 413, under pressure, into the output chamber 407, through the non return check valve 411 to the outlet 403. The non-return check valve 411 prevents any of the volume of the fluid being transferred to the outlet returning to the main chamber 413. As a result a volume, v1, of fluid is transferred from the pump inlet 401 to the pump outlet 403. The process is repeated such that in a unit of time, the volume of fluid is transferred a number of times, the duty cycle of the pump.

Although an eccentric diaphragm pump is described with respect to this example, it can be appreciated that other types of pumps may be utilised, for example peristaltic pumps, centrifugal pumps, membrane pumps, piston pumps, or the like.

However, small differences between these pumps due to tolerances in manufacturing process etc cause slight variations in the volume v1 of fluid that is transferred during each pump cycle.

Figure 5:
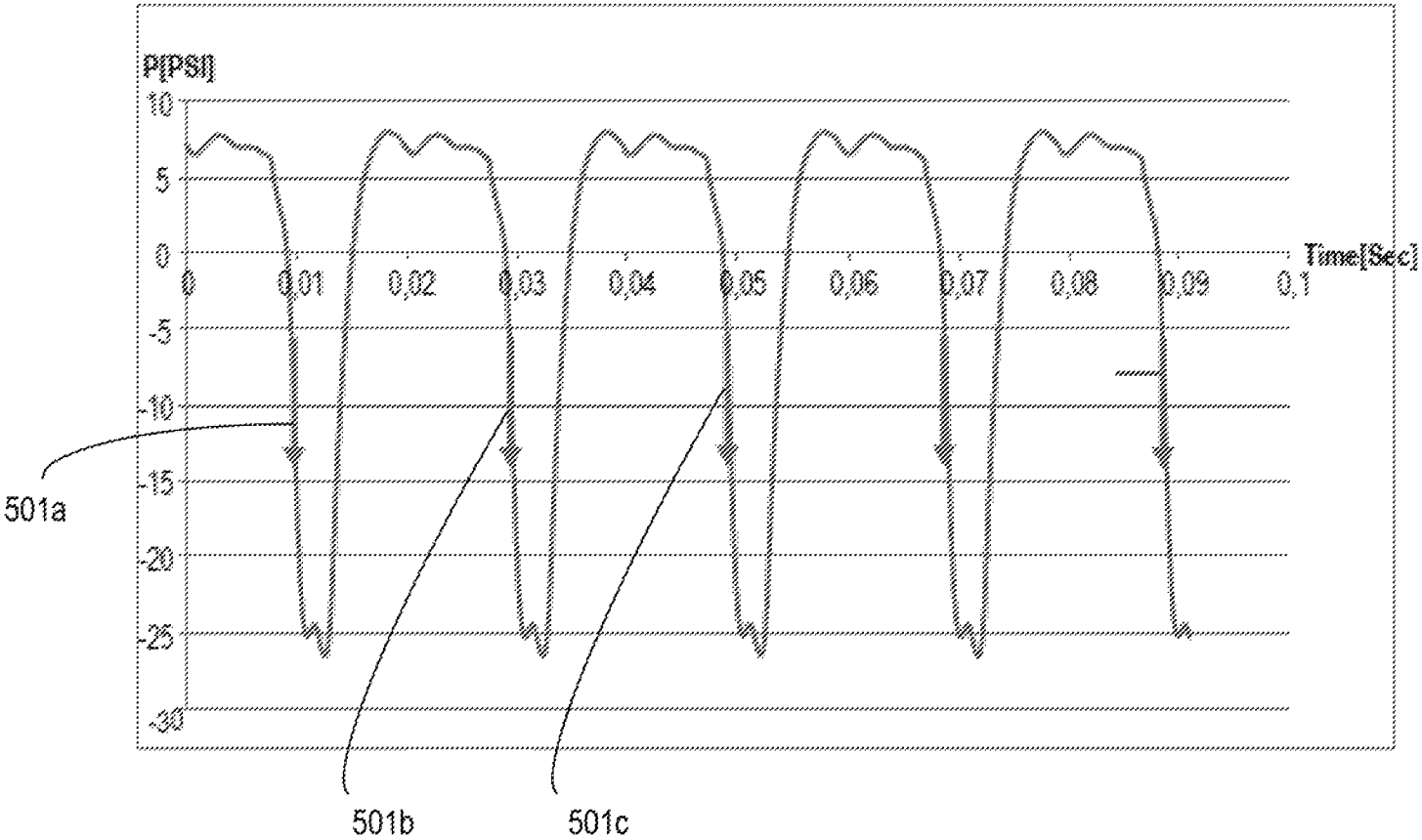
FIG. 5 is an example of a graphical representation of a pressure sensor output of the pressure sensor of the calibration system of FIG. 3*a;*

FIG. 5 shows an example of the pressure sensor 213 output whilst the pump 209 is pumping. Each negative slope 501*a*, 501*b*, 501*c*, . . . , (it could be positive slopes depending on how the pressure sensor is configured) indicates when a volume, v1, has been injected into the tubing 205.

In one example, the count of the number of times a volume of the fluid is transferred from the pump inlet 209*a* to the pump outlet 209*b* in a unit of time is derived from the measured pressure of the fluid (the output of the pressure sensor 213) by counting the number of occurrence of an event, in the unit of time of the measured pressure, for example, from FIG. 5, counting the number of decreases in pressure (negative slopes 501*a*, 501*b*, 501*c* . . . etc) in a unit of time. In another example, by counting the number of increases in pressure (positive slopes) in a unit of time.

In another example, the count may be derived by continuously measuring the pressure and generating a fast Fourier transform of the continuous pressure measurements. The count is then derived as the frequency at which the maximum amplitude of the generated fast Fourier transform occurs. For example, as shown in FIG. 6, the maximum amplitude 603 occurs at a frequency 601, i.e. at 50 Hz.

Figure 6:
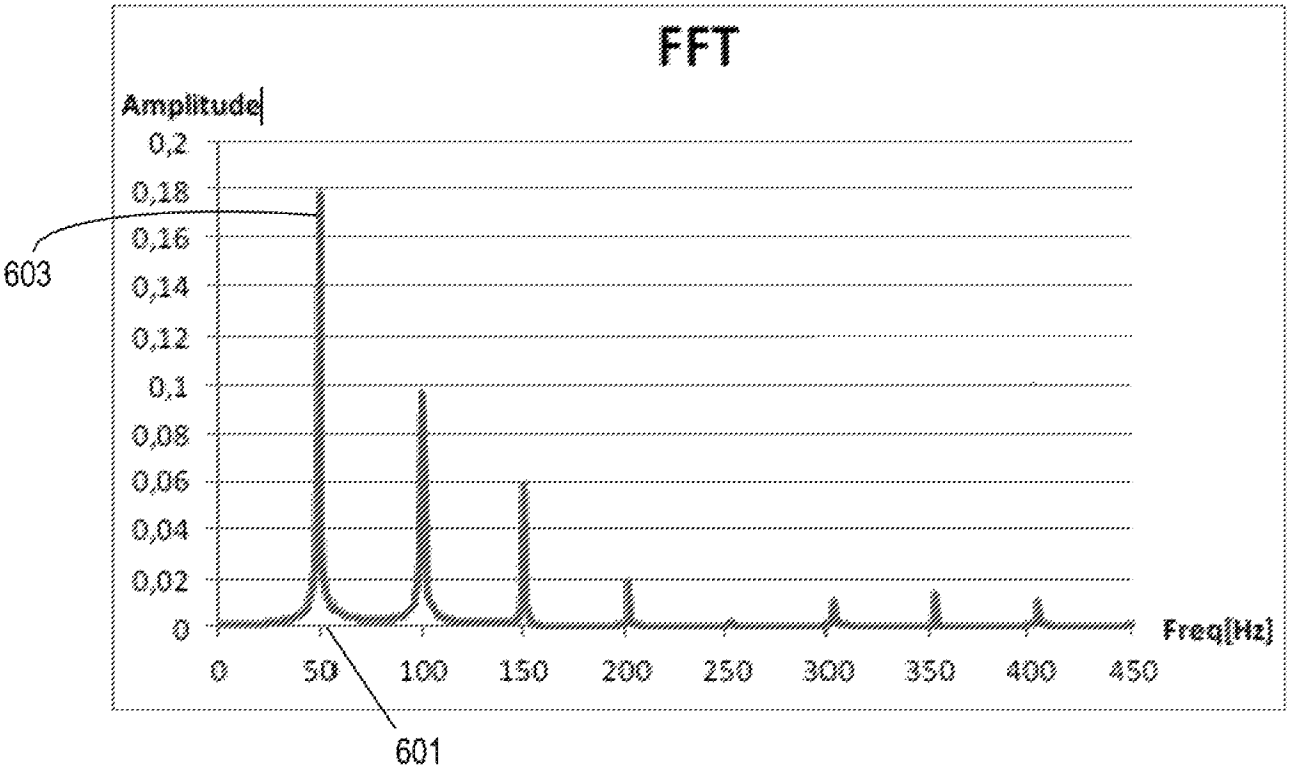
FIG. 6 is an example of a fast Fourier transform of the output of the pressure sensor of the calibration system of FIG. 3*a;*

From the example in FIG. 6, the occurrence of the maximum amplitude is 50 time/sec. Then the exact volume of fluid pumped in a unit of time (100 msec) is:

$$100[\,msec]*50[\,cc/sec]*v1[\,cc] \qquad \text{Equation 1}$$

wherein 100 msec (0.1 sec) is the unit of time; 50 cc/sec is the frequency at which the maximum occurrence of the fast Fourier transform of the pressure sensor output occurs; and v1 is the volume of fluid pumped in a single cycle.

In the example of counting the occurrence of an event of the measured pressure by a comparator, for example, detecting negative/positive slopes of the pressure sensor output, for example, counting the occurrence of negative slopes, as shown for example in FIG. 5, the amount of ink injected into tubing 205 in a unit in time (100 msec) is:

$$100[\,msec]*5[counts/100\ msec]*v1[\,cc/count] \qquad \text{Equation 2}$$

wherein 100 msec is the unit of time (for Equation 2 this term equals 1); 5 counts/100 ms is number of occurrences of a negative slope in 100 ms; and v1 is the volume of fluid pumped in a single cycle.

The volumes calculated by Equations 1 and 2 for the above examples are the same for the same unit volume v1 since: the frequency at which the maximum amplitude of the fast Fourier transform occurrences in the example shown in FIG. 6 is 50 Hz which is 50 times in one second and, in the example shown in FIG. 5, the count of the number occurrences is 5 counts in 100 msec which is equivalent to 50 times in one second (50 Hz).

In an example, the printing apparatus comprises a plurality of pumps and to ensure that differences in the volume pumped in a single cycle, v1, of each pump which may be caused in the tolerances in the manufacture of such pumps, the pumps can be calibrated by using the calibration method of the examples described above.

To calibrate the plurality of pumps to produce the same pumped volume at the same time, the calibrator can adjust the duty cycle (Duty) of each pump and hence adjust the number of times the volume is pumped in a unit of time. For a membrane pump with DC motor, for example, the duty cycle is directly related to the voltage applied, $$V_{apply_to_pump}=\text{MainVoltage}*\text{Duty}. \qquad \text{Equation 3}$$

wherein $V_{apply_to_pump}$ is the voltage applied to the pump; MainVoltage is the maximum voltage that can be delivered to the pump in its operating range; and Duty is the duty cycle of the pump.

From Equation 3, $V_{apply_to_pump}$ is directly proportional to frequency or read counts.

Then in printing apparatus having a plurality of pumps with difference in their pump volume caused by manufacturing tolerances can be calibrated to transfer the same volume to the removably, insertable supply tanks of the printing apparatus:

$$V\text{apply_to_pump1}=\text{Duty1}*V\text{MainVoltage}\rightarrow\text{Freq_target}$$

$$V\text{apply_to_pump2}=\text{Duty2}*V\text{MainVoltage}\rightarrow\text{Freq_target}$$

$$V\text{apply_to_pump}N=\text{Duty}N*V\text{MainVoltage}\rightarrow\text{Freq_target}$$

Each pump voltage is adjusted until it reaches the predetermined frequency threshold value (target). Therefore, in adjusting the duty cycle of each pump, that is, the number of transfers of volume the total volume transferred in a unit of time can be calibrated.

Figure 7A:
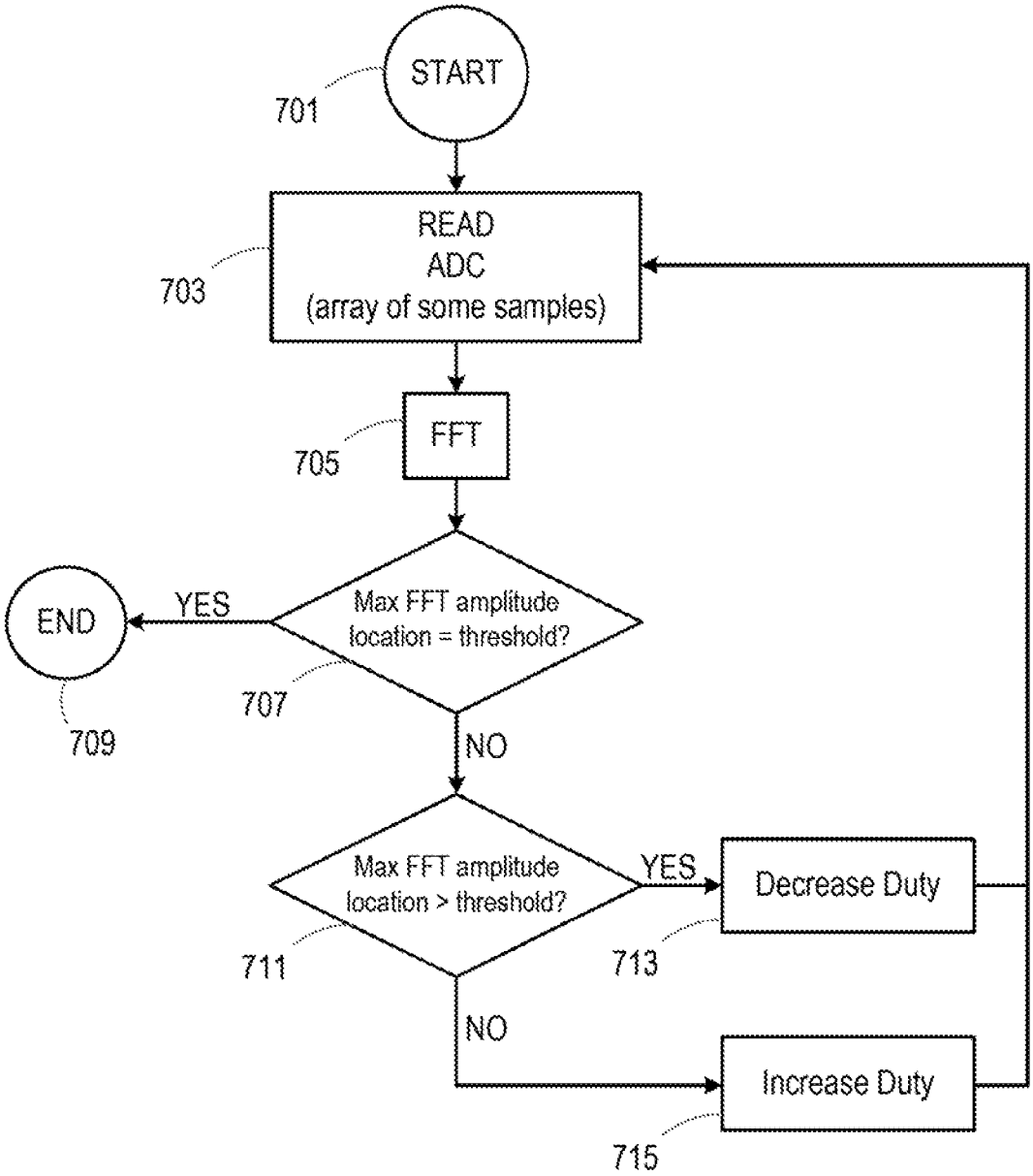
FIG. 7*a* is a flowchart of a more detailed example of a method of calibrating a pump.

One example of a method of calibrating a pump is shown in FIG. 7*a*. Upon initialisation of the calibration process, 701, readings of the output of the pressure sensor are taken, 703. The pressure measurement is continuously taken within a predetermined, adjustable time interval and samples of the pressure measurement are output. These output samples are fast Fourier transformed, 705. From the resulting fast Fourier transform, the frequency at which the maximum amplitude of the fast Fourier transform occurs (e.g. frequency 601 of FIG. 6) is compared with a predetermined threshold frequency value, 707. If the frequency at which the maximum amplitude of the fast Fourier transform occurs is substantially equal to the predetermined threshold frequency value, for example, within ±3 Hz of the predetermined threshold frequency value to provide the preset accuracy for the calibration process, the process ends, 709. The calibration process may be initiated at regular time intervals or may be initiated in response to a predetermined event, such as, for example, when the accessory 201 is connected to the printing apparatus, or when the printing apparatus is powered up, or every n times the removably, insertable fluid supply tank is replaced within the printing apparatus, or any combination thereof.

If the frequency at which the maximum amplitude of the fast Fourier transform occurs is not substantially equal to the predetermined threshold frequency value, 707, it is determined whether the frequency at which the maximum amplitude of the fast Fourier transform occurs is greater than or less than the predetermined threshold frequency value, 711. If it is determined that the frequency at which the maximum amplitude of the fast Fourier transform occurs is greater than the predetermined threshold frequency value, 711, the duty cycle of the pump is decreased, 713, that is the number of times the volume is pumped is decreased and hence the total volume of fluid pumped in a unit of time is decreased until the frequency at which the maximum amplitude occurs is substantially equal to the predetermined threshold frequency value and then the calibration process ends, 709. If it is determined that the frequency at which the maximum amplitude of the fast Fourier transform occurs is less than the predetermined threshold frequency value, 711, the duty cycle of the pump is increased, 715, that is, the number of times the volume is pumped is increased and hence increases the total volume of fluid pumped in a unit of time until the frequency at which the maximum amplitude occurs is substantially equal to the predetermined threshold frequency value and then the calibration process ends, 709.

Figure 7B:
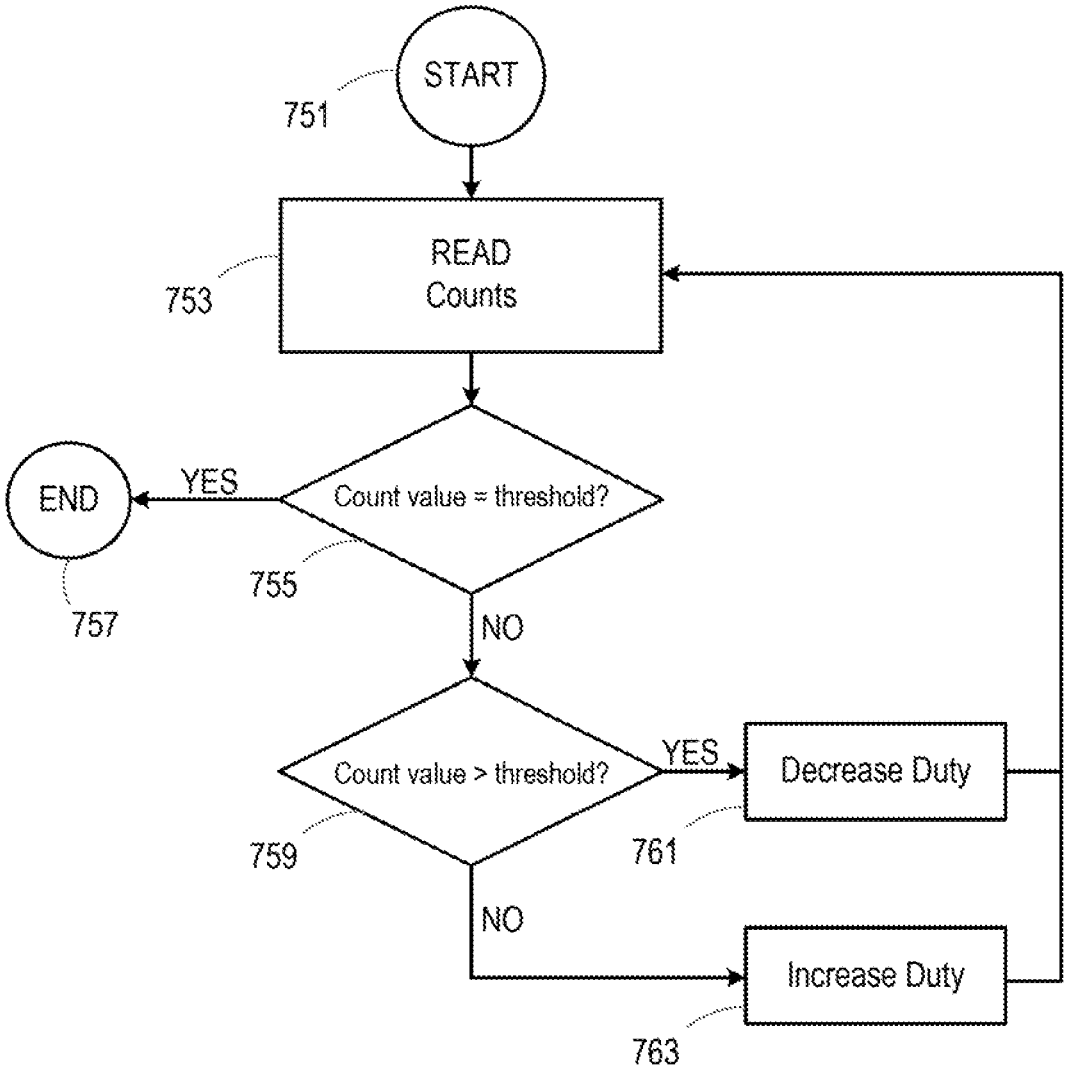
FIG. 7*b* is a flowchart of a more detailed, alternative example of a method of calibrating a pump.
Figure 8:
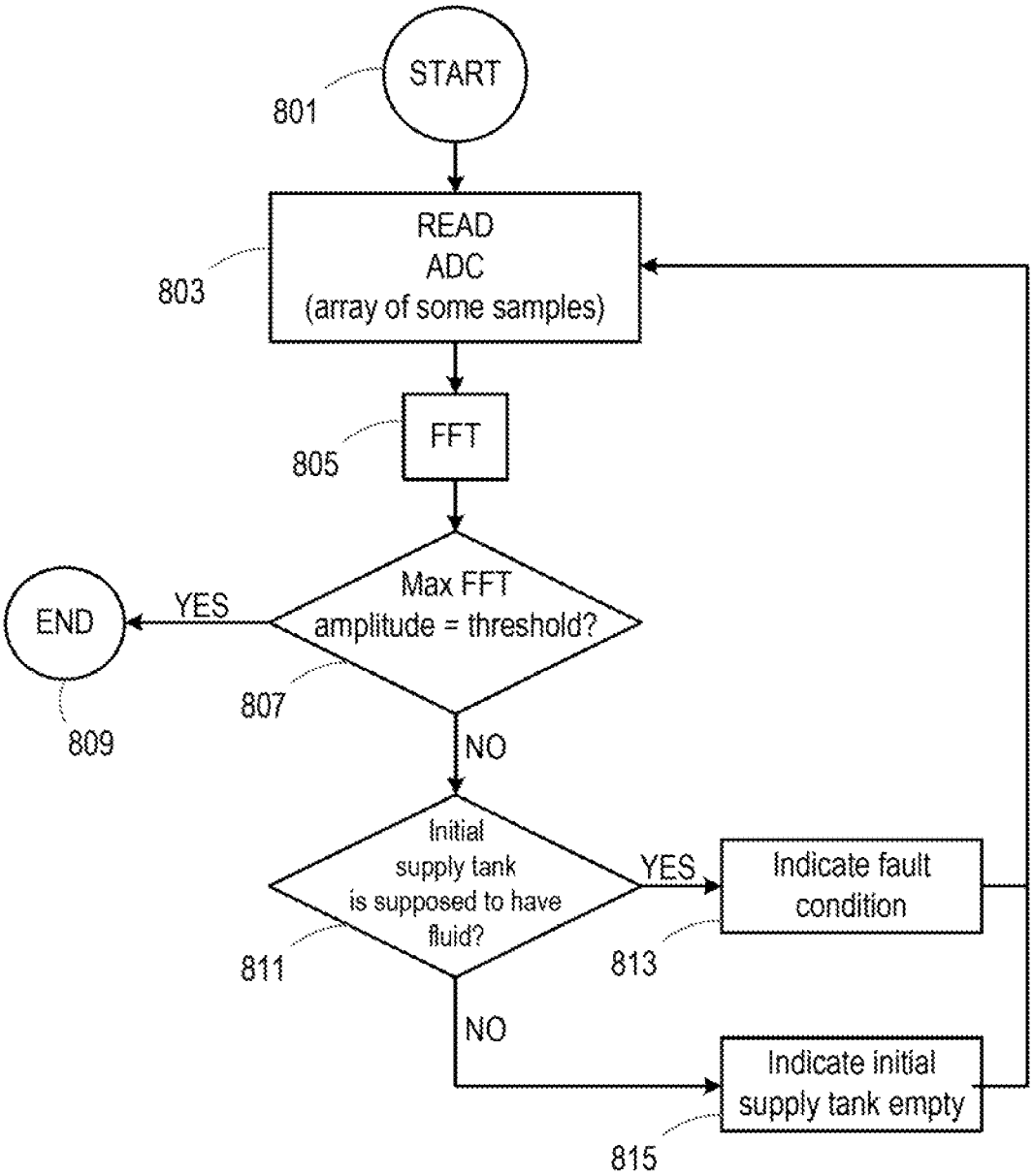
FIG. 8 is a flowchart of detecting a fault in a pump.

In another example, shown in FIG. 7*b*, the calibration process is initiated, 751, a count of occurrences in the output readings of the pressure sensor is taken, 753. For example a count of the negative and/or positive slopes of the pressure sensor output. If the count is substantially equal to a predetermined threshold value, the process ends, 757. The calibration process may be initiated at regular time intervals or may be initiated in response to a predetermined event, such as, for example, when the accessory 201 is connected to the printing apparatus, or when the printing apparatus is powered up, or every n times the removably, insertable fluid supply tank is replaced within the printing apparatus, when a pump is replaced, or any combination thereof.

If the count is not substantially equal to the predetermined threshold value, 755, it is determined whether the count is greater than or less than the predetermined threshold value, 759. If it is determined that the count is greater than the predetermined threshold value, 759, the duty cycle of the pump is decreased, 761, that is the number of times the volume is pumped is decreased and hence decrease the total volume of fluid pumped in a unit of time is decreased until the count is substantially equal to the predetermined threshold value and then the calibration process ends, 757. If it is determined that the count is less than the predetermined threshold value, 759, the duty cycle of the pump is increased, 763, that is, the number of times the volume is pumped is increased and hence increase the total volume of fluid pumped in a unit of time is increased until the count is substantially equal to the predetermined threshold value and then the calibration process ends, 757.

Further either of the method of the example of FIG. 7*a* may be utilised to detect a fault in the pump or one of the plurality of pumps of the printing apparatus whilst the calibration process is being performed.

Once the process is started, 801, a reading of the output of the pressure sensor is taken, 803. The pressure measurement is continuously taken and samples of the pressure measurement are output. These output samples are fast Fourier transformed, 805. From the resulting fast Fourier transform, the value of the maximum amplitude of the fast Fourier transform is compared, 807, with a predetermined threshold amplitude value. If the maximum amplitude of the fast Fourier transform is substantially equal to the predetermined threshold amplitude value, the process ends, 809.

If it is determined that the maximum amplitude of the fast Fourier transform is not substantially equal to the predetermined threshold amplitude value, a check is made as to whether the initial supply tank is empty, 811. This may be performed by monitoring and determining a cumulative amount of printing fluid that has been printed from the removeably insertable (intermediate) fluid supply tank of the printing apparatus through the print head of the printing apparatus. If it is established that fluid remains in the initial supply tank and the maximum amplitude of the fast Fourier transform is not substantially equal to the predetermined threshold amplitude value, then a fault condition is indicated, 813. If it is established that the initial supply tank is empty and the maximum amplitude of the fast Fourier transform is not substantially equal to the predetermined threshold amplitude value, then no fault is indicated and it is indicated that the initial supply tank is empty, 815.

The accessory 201 utilises lamer supply tanks (cartridges), for example 3000 cc to be used with existing printing apparatus providing greater autonomy with less human intervention. The accessory 201 may be provided as a complete plug-in unit helping to protect the user from ink leakages during installation of the accessory.

The accessory detects the pumping process and behaviour such that pumps can pump printing fluid from larger 3000 cc supply tanks (cartridges) to smaller 775 cc intermediate supply tanks.

The calibration system provides the capability of transferring printing fluid volumes with very high accuracy even with different pump volumes.

The system also provides means of detecting when the initial supply tanks are empty. For example, as the initial fluid supply tank empties, the measured pressure at the pump outlet reduces. These measurements can then be used to deduce when the initial fluid supply tank is empty, e.g. when the amplitude of the pressure sensor output reaches a predetermined threshold value. In one example, this is achieved by taking a moving standard deviation of the pressure sensor output and comparing this to a predetermined threshold value such that when the threshold value is reached, it is determined that the initial fluid supply tank is empty.

Further, it is no longer necessary to stop pumping to measure pressure without noise in order to know how much printing fluid the intermediate tank has. Since the noise created by the pump operation prevents static pressure measurements, in order to measure the static pressure, the pump action is, periodically, stopped. Any reduction in the static pressure would then provide an indication that the intermediate fluid supply tank has been completely refilled from the initial fluid supply tank. However, the accessory device described above does not static pressure measurements to detect when the intermediate tank has been refilled. Since, after calibration as described above, the pump operates in a standard manner, the fill volume can be accurately determined. The calibration of the pump ensures an accurate amount of fluid is transferred in a unit of time. Therefore, the mere operation of the pump can be used to provide an accurate measure of the fill volume without the pumping action being stopped.

The examples described above further provide detection of defective pumps during the calibration process.

Pump wastage diagnosis capability can also be achieved with the accessory device described above. For example, if a pressure sensor is provided at the pump outlet 209*b* and another at the inlet of the intermediate tank and, during the calibration process, a pressure is detected at the pump outlet 209*b* and not at the inlet of the intermediate tank, this would indicate that there is leakage in the tubing between the pump and the intermediate tank.

It should be noted that the above-mentioned examples illustrate rather than limit what is described herein, and that those skilled in the art will be able to design many alternative implementations without departing from the scope of the appended claims. The word "comprising" does not exclude the presence of elements other than those listed in a claim, "a" or "an" does not exclude a plurality, and a single processor or other unit may fulfil the functions of several units recited in the claims.

The invention claimed is:

1. A method for calibrating a pump, the method comprising measuring the pressure of a fluid at a pump outlet of the pump or down stream of the pump outlet;

deriving a count of the number of times a volume of the fluid is transferred from a pump inlet to the pump outlet of a pump in a unit of time, from the measured pressure of the fluid; and adjusting the number of times the volume is transferred in the unit of time until the derived count is substantially equal to a predetermined threshold value to calibrate the pump to transfer a predetermined total volume of fluid from the pump inlet to the pump outlet in the unit of time.

2. The method of claim 1, wherein deriving a count of the number of times a volume of the fluid is transferred from an inlet to an outlet in a unit of time from the measured pressure of the fluid comprises counting the number of occurrence of an event in the unit of time of the measured pressure.

3. The method of claim 2, wherein counting the number of occurrence of an event comprises counting the number of increases in pressure or the number of decreases in pressure of the measured pressure in the unit of time.

4. The method of claim 2, wherein adjusting the number of times the volume is transferred comprises adjusting the number of times the volume is transferred until the count of the number of occurrences is substantially equal to a predetermined threshold value.

5. The method of claim 1, wherein deriving a count of the number of times the volume of the fluid is transferred in a unit of time comprises generating a fast Fourier transform of the pressure measurements;

deriving the count as the frequency at which the maximum amplitude of the generated fast Fourier transform occurs; and wherein adjusting the number of times the volume is transferred comprises increasing the number of times the volume within a unit of time is transferred if the frequency at which a maximum amplitude of the generated fast Fourier transform occurs is less than the predetermined threshold value until the frequency at which a maximum amplitude of the generated fast Fourier transform occurs is substantially equal to the predetermined threshold value; and decreasing the number of times the volume is transferred within a unit of time if the frequency at which a maximum amplitude of the generated fast Fourier transform occurs is greater than a predetermined threshold value until the frequency at which a maximum amplitude of the generated fast Fourier transform occurs is substantially equal to the predetermined threshold value.

6. The method of claim 5, wherein the fluid is transferred from a supply volume of the fluid and the method further comprises detecting a fault condition if it is determined that the maximum amplitude of the generated fast Fourier transform is not substantially equal to a predetermined second threshold value and it is determined that there is an amount of the supply volume of the fluid remaining.

7. The method of claim 1, wherein the method calibrates a plurality of pumps connected in parallel and adjusting the number of times the volume is transferred by each pump to transfer substantially the same total volume at substantially the same time.

8. A calibration system of a pump, the pump to transfer a volume of a fluid from the pump inlet to the pump outlet in a unit of time, the calibration system comprising a pressure sensor to output a measure of the pressure of a fluid at the pump outlet;

a counter to derive a count of the number of times the volume of the fluid is transferred from the pump inlet to the pump outlet in a unit of time, from the pressure sensor output; and an adjustor to adjust the number of times the volume is transferred in a unit of time until the derived count is substantially equal to a predetermined threshold value.

9. The calibration system of claim 8, wherein the adjustor is to adjust the duty cycle of the pump to adjust the number of times the volume is transferred in a unit of time.

10. The calibration system of claim 8, wherein the calibration system calibrates a plurality of pumps connected in parallel and the adjustor is to adjust the number of times the volume is transferred by each pump to transfer substantially the same amount of fluid at substantially the same time.

11. An accessory of a printing apparatus, the printing apparatus comprising an interface to receive at least one removably insertable fluid supply tank, the accessory comprising at least one initial supply tank to contain a supply volume of a printing fluid;

at least one pump to transfer an amount of the printing fluid from each at least one initial supply tank to each corresponding at least one removably insertable fluid supply tank when inserted in the interface of the printer;

at least one pressure sensor to output a measure of the pressure of a volume of transferred printing fluid at an outlet of each at least one pump;

a calibrator to derive a count of the number of times the volume of the fluid is transferred in a unit of time from the pressure sensor output and to adjust the number of times the volume is transferred in a unit of time until the derived count is substantially equal to a predetermined threshold value.

12. The accessory of claim 11, wherein the calibrator is further to determine the total amount of printing fluid transferred from each at least one initial supply tank to each corresponding at least one removably insertable fluid supply tank when inserted in the interface of the printer; and to provide an output to indicate that the at least one removably insertable fluid supply tank is full.

13. The accessory of claim 11, wherein the calibrator is further to determine when each at least one removably insertable fluid supply tank, when inserted in the interface of the printer, is empty when a moving standard deviation of the measure of the pressure output by each corresponding at least one pressure sensor reaches a predetermined threshold value.

* * * * *